United States Patent [19]

Siemers

[11] Patent Number: 4,838,337

[45] Date of Patent: Jun. 13, 1989

[54] METHOD OF FABRICATING TITANIUM ALLOYS IN FOIL FORM

[75] Inventor: Paul A. Siemers, Clifton Park, N.Y.

[73] Assignee: General Electric Company, Schenectady, N.Y.

[21] Appl. No.: 10,655

[22] Filed: Feb. 4, 1987

[51] Int. Cl.[4] ..... B22D 23/00

[52] U.S. Cl. ..... 164/46; 427/34

[58] Field of Search ..... 164/46, 131, 97, 108, 164/110; 427/34

[56] References Cited

U.S. PATENT DOCUMENTS

| | | | |
|---|---|---|---|
| 4,537,742 | 8/1985 | Siemers et al. | 427/34 X |
| 4,574,451 | 3/1986 | Smashey et al. | 164/46 X |
| 4,576,828 | 3/1986 | Walker, Jr. | 427/34 |

OTHER PUBLICATIONS

Mash, D. R. et al., "Structure and Properties of Plasma Cast Materials", In Metals Engineering Quarterly, Feb. 1964, p. 18.

*Primary Examiner*—Donald P. Walsh

*Attorney, Agent, or Firm*—Paul E. Rochford; James C. Davis Jr.; James Magee, Jr.

[57] ABSTRACT

A method for forming a titanium metal foil is provided. The titanium metal may be essentially any titanium alloy. The alloy is first provided in powder form. The powder is sprayed through a low pressure RF plasma deposition apparatus onto a preformed foil mounted onto a rotating drum. The preformed foil is removed from the drum after plasma deposit of the layer of titanium alloy and the preformed foil is removed from the plasma deposit foil to leave a free standing foil of the titanium alloy.

10 Claims, 4 Drawing Sheets

RF Ti-6AL-4V

METHOD OF FABRICATING TITANIUM ALLOYS IN FOIL FORM

BACKGROUND OF THE INVENTION

The present invention relates to the fabrication of foils of various titanium alloys.

More specifically, it relates to the fabrication of foils in the order of thousandths of an inch in thickness of titanium base alloys for various applications, such as the formation of composites of reinforced titanium alloys. Such composites may include layers of high strength fibers, such as SiC fibers, together with thin layers of titanium foil in the form of a laminate.

It is known that silicon carbide fibers can be formed with great strength and with high temperature tolerance. It is also known that titanium foils have been used in connection with SiC fibers to produce SiC reinforced composites in which the SiC fibers are embedded in a sheet of titanium alloy made up of a number of layers of foil. Such SiC reinforced titanium alloy composites have been identified as potential high strength materials, that is materials which have high strength to weight ratio. Such materials are deemed to be attractive for use in future aircraft engines having high thrust to weight ratios and in wing structures of transatmospheric vehicles. It is anticipated that such titanium alloy matrix composites and laminates will find application in wound rotors and in casings and in other intermediate temperature high stress applications.

Under prior art practice, titanium alloy composites have been fabricated by rolling the desired titanium alloy ingot to about 0.008 to 0.010 inch thick sheet. The sheet is employed as alternate layers in a lay up of titanium alloy sheet and an array of parallel SiC fibers held together with very fine Ti ribbon to form a preconsolidated assembly. The assembly is then consolidated by hot pressing or hot isostatic pressing (HIPing).

As used herein the term titanium base alloy means an alloy composition in which titanium is at least half of the composition when the various alloy constituents are specified in percentage by weight.

A titanium aluminum intermetallic compound is a titanium base alloy composition in which titanium and aluminum are present in a simple numerical atomic ratio and the titanium and aluminum are distributed in the composition in a crystal form which corresponds approximately to the simple numerical ratio such as 3:1 for $Ti_3Al$, 1:1 for TiAl, or 1:3 for $TiAl_3$.

$Ti_3Al$ compositions have use temperatures of up to about 1400° F. as compared to the use temperatures of titanium alloys such as Ti-6Al-4V of up to about 1000° F. The use temperature of TiAl is in the 1700°-1800° F. range.

Fabrication of such thin titanium base alloy sheets for formation of such a composite can be very costly. This is particularly so if the titanium base alloy is not ductile at room temperature. One alloy which lacks such room temperature ductility is niobium modified intermetallic compound having the crystal form of $Ti_3Al$ (Ti-14Al-21Cb). This alloy can only be rolled to foils of about 0.020 inch thick. To obtain thinner sheet requires that the thicker sheet be electrochemically machined to the desired thickness. If the final desired thickness is 0.010 inch, then about half of the original material is lost.

Novel and unique structures are formed pursuant to the present invention by plasma spray deposition of titanium base alloys and titanium-aluminum intermetallic compounds employing radio frequency (RF) plasma spray apparatus.

The formation of plasma spray deposits of titanium and of alloys and of titanium intermetallic compounds present a set of processing problems which are unlike those of most other high temperature high strength materials such as the superalloys. A superalloy such as a nickel base or iron base superalloy can be subdivided to relatively small size particles of −400 mesh (about 37 μm) or smaller without causing the powder to accumulate a significant surface deposit of oxygen. A nickel base superalloy in powder form having particle size of less than −400 mesh will typically have from about 200 to about 400 parts per million of oxygen. A powdered titanium alloy by contrast will typically have a ten fold higher concentration of oxygen. A powdered titanium alloy of −400 mesh will have between about 2000 and 4000 ppm of oxygen.

Moreover titanium base alloy powder of less than −400 mesh size is recognized as being potentially pyrophoric and as requiring special handling to avoid pyrophoric behavior.

It is also recognized that the low temperature ductility of titanium alloys decreases as the concentration of oxygen and of nitrogen which they contain increases. It is accordingly important to keep the oxygen and nitrogen content of titanium base alloys at a minimum.

Prior art plasma spray technology is based primarily on use of direct current plasma guns. It has been recognized that most as-sprayed plasma spray deposits of the superalloys such as nickel and iron base superalloys have had relatively low ductility and that such deposits when in their sheet form can be cracked when bent through a sufficiently acute angle due to the low ductility.

I have discovered that RF plasma apparatus is capable of spraying powder of much larger particle size than the conventional d.c. plasma apparatus. I have discovered that particle sizes at least three times larger in diameter than those conventionally employed in d.c. plasma spray apparatus may be successfully employed as plasma spray practices and that the particle size may be as high as 100 μm to 250 μm and larger and as large as 10× as large as the −400 mesh powder (37 μm) previously employed in d.c. plasma spray practice.

This possibility of employing the larger powder particles is quite important for metal powders such as titanium base alloys which are subject to reaction and absorption of gases such as nitrogen and oxygen on their surfaces. One reason is that the surface area of particles relative to their mass decreases inversely as their diameters. Accordingly, a three fold increase in particle diameter translates into a three fold decrease in particle surface area to volume. I have discovered that one result is that RF plasma spray deposited structures of titanium base alloys made with the aid of larger particles have lower oxygen content than might be expected based on knowledge of prior art practices.

BRIEF STATEMENT OF THE INVENTION

It is, accordingly, one object of the present invention to provide a novel fabrication technique by which foils of titanium alloys may be formed in desired thicknesses.

Another object is to provide a method for forming a titanium base metal foil of small thickness from an alloy which can be rolled to such a small thickness only with difficulty.

Another object is to provide a titanium alloy foil having highly desirable physical properties.

Another object is to provide a foil of titanium metal alloy of dimensions suitable for use in formation of laminates with silicon carbide or similar reinforcing fibers.

Other objects will be in part apparent and in part pointed out in the description which follows.

In one of its broader aspects, objects of the present invention can be achieved by providing a radio frequency powered low pressure plasma spray apparatus, providing a powder of a titanium base alloy having an average particle size in excess of 100 μm, plasma spray depositing said titanium base alloy onto a substrate surface to produce a foil of said titanium base alloy, separating said foil from said substrate surface, and heat treating the foil to improve its properties.

BRIEF DESCRIPTION OF THE DRAWINGS

The application and the description of the invention which follows will be understood with greater clarity by reference to the accompanying drawings in which.

DETAILED DESCRIPTION OF THE PRESENT INVENTION

Figure 1:
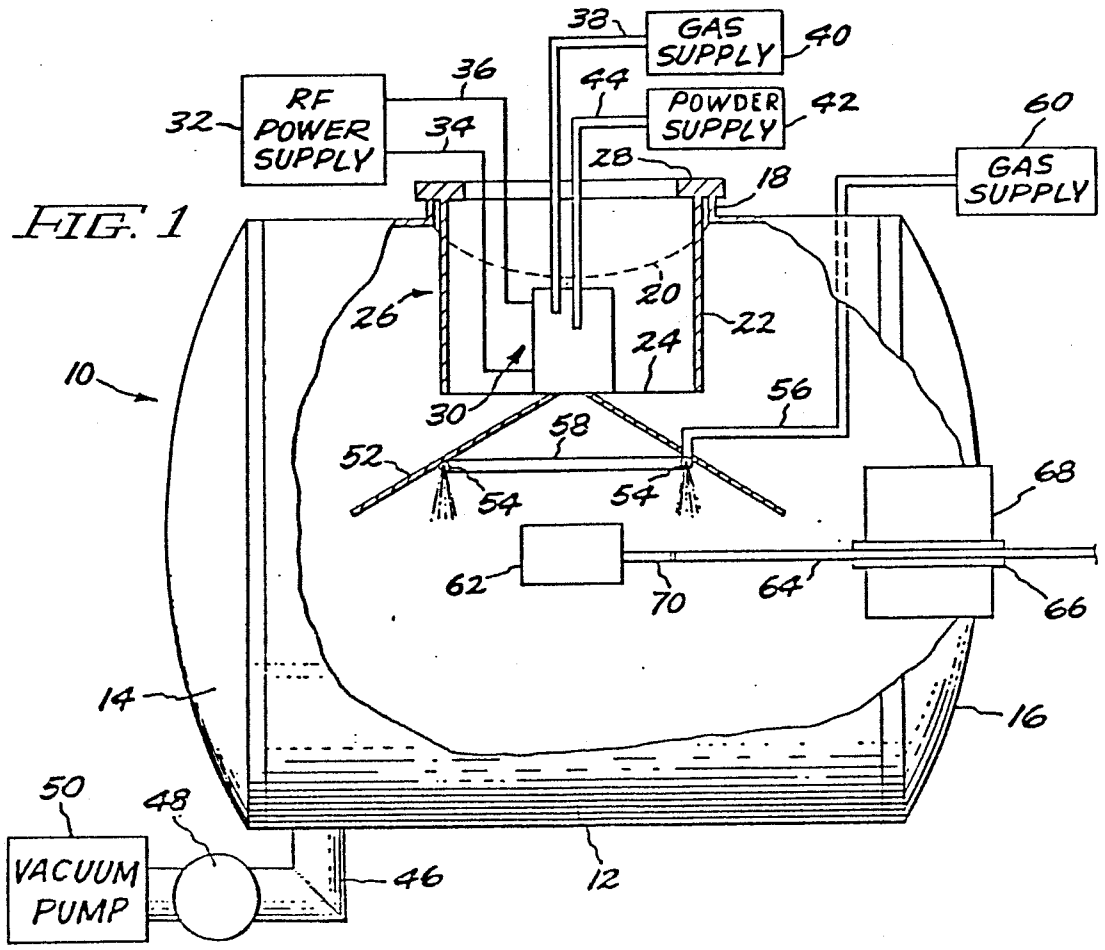
FIG. 1 is a schematic illustration of a low pressure RF plasma gun and deposition apparatus.

A low pressure radio frequency plasma spray deposit apparatus 10 is made up of a tank 12 having two removable end caps 14 and 16 and the associated apparatus as illustrated in FIG. 1. The tank may have a length of about 5 feet and a diameter of about 5 feet.

At the top of the tank 12 provision is made for introduction of an RF plasma gun into the top of the tank through an opening formed by cutting an opening in the tank wall and welding a collar 18 to the top of tank 12 along seam 20. The RF gun introduced into the tank is positioned within a container in the form of an inverted hat. The hat has sidewalls 22 and bottom wall 24 and has a rim 28 which seats on the collar 18 to provide a hermetic seal by techniques well known in the art.

The gun itself 30 is described in greater detail with reference to FIG. 2. The gun is mounted to the bottom wall 24 of the inverted hat container 26 and is supplied by power; by gas and by powder entrained in a carrier gas.

An RF power supply 32 delivers power to the gun 30 over lines 34 and 36. Greater details of its operation are given below with reference to FIG. 2.

Gas is supplied to the interior of gun 30 from gas source 40 through gas supply 38. Gas supply means 38 is representative of the means for supply of hydrogen gas or helium gas or argon gas or any mixture of gases as may be needed by the commercially available RF plasma gun such as TAFA Model 66 used in connection with the examples below. The specific gases employed depend on the material being plasma sprayed and the specific gases to be used are known in the art. Also powder, entrained in a carrier gas, is supplied to the plasma gun from a powder supply means 42 through piping 44.

A low pressure of 200 to 400 torr is maintained within the tank 12 by means of a pump 50 operating through valve 48 and line 46 connected to the tank 12.

A problem of arc striking against wall interiors from the plasma was studied and was overcome by incorporation of a conical metal shield 52 extending down from gun 30 and by use of gas jets 54 disposed around the plasma flame from gun 30. Gas is supplied to the jets through the pipe 56 from exterior gas supply means 60. The jets are formed by gas flowing through openings drilled through an annular pipe mounted beneath conical shield 52. The pipe 58 serves as a manifold for the gas as well as providing the bottom drilled openings from which the gas jets 54 emerge.

The object illustrated as that to be coated by plasma spray deposit is a cylindrical drum 62 held by attached bolt 70 at the end of an arm 64 extending through one end cap 16 of the tank 12. The arm 64 is hermetically sealed through the end cap 16 by a bushing 66 which is mounted within the box 68. Conventional means are provided in the box 68 for vertical positioning of the bushing 66 before the apparatus is evacuated. The rod may be raised or lowered to permit the position of drum 62 or other sample attached at the end of rod 64 to be adjusted to appropriate positions for the coating process to be performed prior to evacuation of tank 12.

While the plasma spray deposition is in progress, sliding lateral positioning of the drum by inward and outward movement of rod 64 through bushing 66 is also feasible. The drum is subject to rotation by imparting a rotary motion to the external portion of rod 64 by conventional means.

Figure 2:
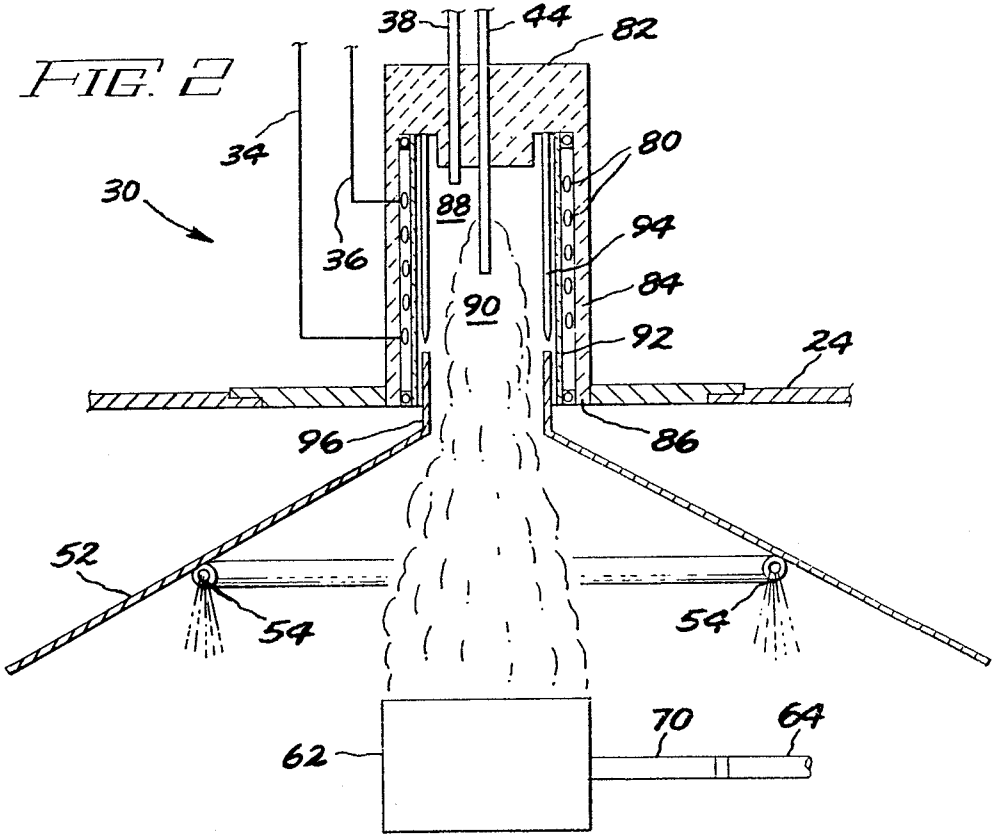
FIG. 2 is a schematic diagram of system for low pressure RF plasma deposition onto a rotating drum.

Turning now to FIG. 2, a more detailed description of the plasma gun and its operation is provided.

The elements shown in both FIGS. 1 and 2 which bear the same reference numerals are the same articles. It is evident from FIG. 2 that the gun 30 has RF electric supply means 34 and 36 which are the same as those illustrated in FIG. 1. These means are known in the art to be hollow tubes which carry the RF energy and which also carry water to and from the gun for water cooling. Water cooling is necessary because of the high temperature of 10,000° to 12,000° K. generated within the gun.

Also, the gas supply pipe 38 and powder supply pipe 44 are provided in supply relationship to the elements of gun 30 as they were in FIG. 1.

The gun 30 is provided with a housing, which includes a closed top wall 82, side walls 84 and a lower opening 86 from which the plasma flame extends.

Powder supply means 44 is a triple wall tube having a hollow innermost center tube for supply of powder and carrier gas. The triple wall is made up of a set of three concentric tubes having a cooling liquid, such as water, flowing in cooling relation in the inner and outer passages between the concentric tubes of powder supply means 44.

The gas is injected from means 38 into the top of the chamber 88 within gun 30 and above the region in chamber 88 where the plasma is formed. The plasma 90 itself is generated by having the radio frequency power impressed on the gas within the chamber 88. A suitable frequency range is from 2 to 5 megahertz. The lower end of this range is preferred.

The RF power is delivered through the lines 34 and 36 to a helical coil built concentric to the sidewalls 84 of the gun 30. Individual strands 80 of the coil are evident in section in FIG. 2. The RF coil, made up of strands 80, is separated from the chamber 88 and plasma 90 by a quartz tube 92 mounted as a liner within the gun 30. A water cooled copper liner 94 made up of a ring of water cooled fingers is also provided in gun 30 within quartz tube 92 as it has been found to assist the operation of the gun at higher powers. The space between gun walls 84 and quartz tube 92 is flooded with flowing cooling water (the strands 80 of the coil are in water) so that one side of the quartz tube 92 is directly water cooled.

An exit baffle 96 assists in orienting the flame of the plasma gun 30. The plasma 90 is formed within gun 30 and extends from the bottom of the gun downward into heat delivering relation to the target 63 mounted at the end of rod 64 by a bolt 70.

As explained above, I have found that combination of the stainless steel shield 52 and the gas jets 54 have been successful in preventing an arcing or striking back from the plasma to the walls of the container of the low pressure plasma deposition apparatus 10 as illustrated in FIG. 1.

In operation, a gas or combination of gases is passed through supply means 38 into chamber 88 and the pressure of this gas is kept at a low value by the action of vacuum pump 50 operating through valve 48 and pipe 46 on the low pressure plasma deposition apparatus including tank 12. A pressure of about 250 torr is suitable. The tank itself has a length of about five feet and also a diameter of about five feet. Radio frequency power is impressed on the strands 80 of the coil to excite the gas passing into the housing through means 38. A plasma 90 is generated within the housing of gun 30. The plasma extends out from the housing and heats the surface of rotatable drum 62. The temperature of the plasma is about 10,000° to 12,000° K.

Powdered particles, entrained in a carrier gas, are introduced into the plasma 90 through tube 44. The heat of the plasma 90 is sufficiently high to cause a fusion of the particles as they move through the plasma and are then deposited as liquid droplets on the surface of the drum 62. I have found that the plasma from the RF gun as described above will fuse particles of relatively large diameter of more than 100 μm and will cause them to deposit on a receiving surface from essentially a liquid state.

The vacuum system is operated to maintain a pressure of approximately 250 torr in the low pressure plasma deposition chamber within the container 12. The drum 62 may be rotated within the evacuated chamber as the plasma is used to melt particles into molten droplets to be deposited on the surfaces thereof.

The powder feed mechanism 42 is a conventional commercially available device. One particular model used in the practice of this invention was a powder feeder manufactured by Plasmadyne, Inc. of California. It is equipped with a canister on top that holds the powder. A wheel at the bottom of the canister rotates to feed powder into a powder feed hose 44. The powder is then carried by the carrier gas from the powder feeder along the hose 44 to the chamber 88 of gun 30.

Figure 3:
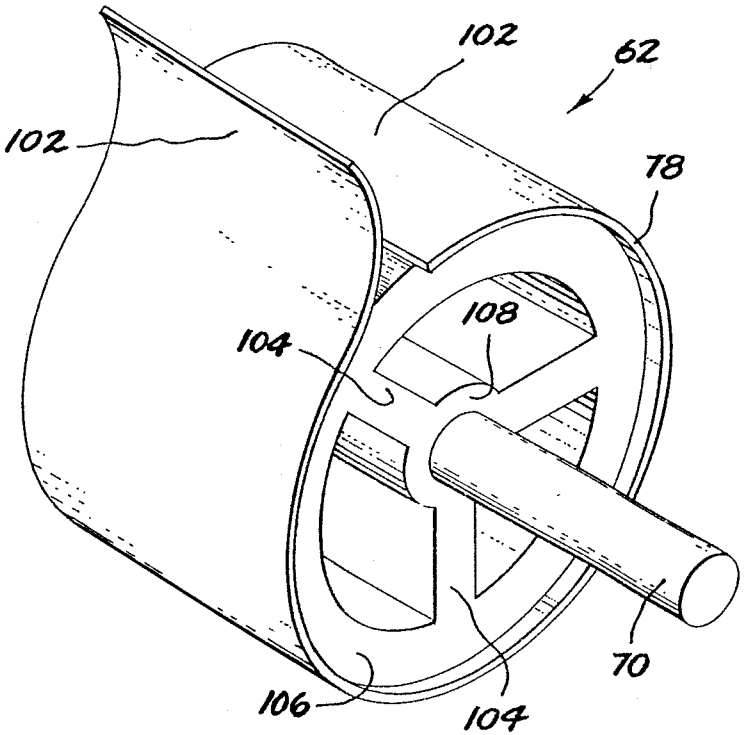
FIG. 3 is a schematic rendering of a drum adapted for receiving a foil on its cylindrical surface.

Turning now to FIG. 3, a schematic illustration of a drum having a substrate foil mounted partially thereon is provided. The drum 62 is formed to receive a preformed foil, such 102, on its external surface. The foil desirably extends over the longitudinal edge of the drum so that any material received thereon will deposit on the foil and not on the drum. Drum 62 may be formed with an internal set of ribs 104 extending between an outer wall 106 and an inner central axle 108. A shaft 70 extends outward from axle 108 and is a means by which the drum 100 is supported within a low pressure plasma apparatus such as tank 12 of FIG. 1. Foil 102 may be clamped into place on drum 62 by conventional means which are not illustrated in FIG. 3.

In operation, the drum is covered with a foil of metal or with some relatively inexpensive mandrel material. The drum is rotated and translated axially and the plasma flame is played on the foil covered surface of the drum. A powder of the desired alloy composition is introduced into the plasma powder feed supply and the drum is sprayed in the low pressure plasma deposition apparatus until a plasma spray of desired sheet thickness is obtained on the surface of the substrate foil. For formation of a highly reactive alloy sheet, such as a titanium alloy, use of larger size powder particles and of a plasma gun powered by radio frequency is necessary in depositing the desired alloy. A radio frequency plasma gun is commercially available and may be obtained, for example, from TAFA Corp. of California, USA. A TAFA model 66 may be employed, for example.

At the conclusion of the spraying of the titanium alloy onto the mandrel foil, the preformed foil and the foil deposited thereon are removed from the reusable drum. The steel preformed foil may be chemically dissolved with an acid solution of nitric and hydrochloric acids to remove it from the deposited foil.

Figure 4:
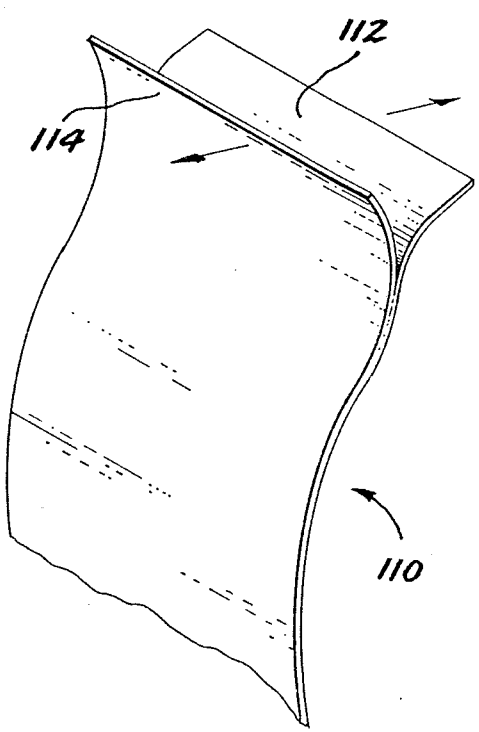
FIG. 4 is a detailed view of a composite foil formed of a titanium alloy on a preformed foil which may be of molybdenum, for example, and showing the two foils being separated from one edge by peeling.

Alternatively, if a substrate sheet of molybdenum metal is employed to receive the titanium alloy sheet deposit, and if during the plasma spraying operation the molybdenum sheet itself does not become excessively heated, then it may not be necessary to employ chemical dissolving agents to remove the molybdenum sheet from the titanium alloy. This is because it has been found possible to separate a preformed sheet of molybdenum from a plasma deposited sheet of titanium alloy by simply peeling the titanium alloy from the molybdenum sheet. This operation is illustrated in FIG. 4, where the composite sheet of molybdenum and titanium 110 is shown to being separated at the top into the substrate sheet of molybdenum 112 and the spray formed sheet of titanium alloy 114. Separating tension is applied at one end of the sheet and the two sheets separate, as shown in the figure, into their respective individual sheets. Where such separation is carried out, the molybdenum sheet which is recovered is in condition for being reused and may accordingly be reused by mounting molybdenum sheet 112 to drum 62 for deposit of yet another layer of titanium alloy.

A typical run might be carried out under the following conditions:

A power input of 60 Kilowatts
A tank pressure of 250 torr
Gas flow rates for a TAFA Model 66:
  Radial, argon: 117 liters/min.
  Swirl, hydrogen: 5 liters/min.
  Swirl, argon: 16 liters/min.
  cold jet argon: 106 liters/min.
Particle Injection:
  Carrier, argon: 5 liters/min.
  Powder, Ti Base Alloy: 210–250 μm Injection point above nozzle: 7.45 cm.

Deposition Data:

Target Material: Preformed Steel Foil
Target Size: 4" wide 7" diam. drum
Distance Target Nozzle: 11.5"
Preheating Time: none
Deposition Time: 3 min.
Deposition Rate: 30 grams/min.
Mass Deposition efficiency: 90–95%

EXAMPLE 1

A powder formed from a titanium base alloy, and specifically Ti-6Al-4V (6 weight percent aluminum-4 weight percent vanadium-balance titanium) by weight percent was obtained. This metal had been prepared by plasma rotating electrode method (PREP) which is a method for preparing powders well known in the art. The average particle size of the powder used in this example was greater than 100 μm.

A 7 inch diameter, 5 inch wide cylindrical drum as illustrated in FIG. 3 was wrapped with a iron foil of 0.005 inch thickness. The foil had been cut so that it completely covered the drum. The drum was attached by bolt 10 to rod 64, the external end of which was controlled by a conventional substrate motion mechanism to have both a rotary motion and a reciprocating translation motion so that all surfaces of the drum were exposed to the plasma of the plasma gun. The drum was disposed in a radio frequency powered low pressure plasma deposition apparatus, as schematically illustrated in FIG. 1. The drum was rotated at 60 revolutions per minute and was given an axial translation motion of about 1 inch per second to expose all portions of the surface of the preformed iron foil on the cylindrical surface of the drum to the flame of the RF plasma gun. The Ti-6Al-4V powdered alloy was sprayed for 3 minutes. This spraying operation resulted in the deposit of 0.008 inch layer of the titanium alloy on the iron foil. The alloy was deposited on the iron foil mounted on the rotating drum as the drum rotated and translated.

The preformed iron foil together with the deposited foil of titanium base alloy were removed from the drum. The preformed iron foil was dissolved away from the plasma deposited titanium foil using a hot 50% nitric acid solution. When all of the iron was dissolved from the deposited alloy, it was apparent that the Ti-6Al-4V powder alloy had been formed into a free standing piece of alloy foil.

EXAMPLE 2

The procedure of Example 1 was repeated, but in this case the alloy deposited was a Ti-6Al-2Sn-4Zr-2Mo by weight percent. Again, a free standing piece of alloy sheet was formed following the removal of the iron foil by dissolution in hot nitric acid.

EXAMPLE 3

The procedure of Example 1 was again repeated. However, in this case the titanium alloy powder which was employed in the plasma spray formation of a sheet was a niobium modified intermetallic compound based on $Ti_3Al$ crystal form (Ti-14Al-21Cb). The niobium modified $Ti_3Al$ is according to the formula Ti-21Al-14Nb. A three minute spray resulted in a 0.008 inch thick free standing foil of niobium modified $Ti_3Al$ once it had been removed from the iron foil by dissolution in nitric acid.

The forgoing discussion and examples demonstrates that as a matter of practical operations and employing the art of plasma spray processing, it is possible to fabricate a free standing foil of essentially any titanium base alloy or intermetallic compound, by the RF plasma spray process, depending on the availability of the titanium alloy or intermetallic compound in powder form with average particle size above the size range, preferably of 100 μm or larger, where pyrophoric phenomena are of concern.

It is also deemed possible to spray alloy structures based on TiAl crystal structures. It is known that the TiAl alloys are extremely difficult to fabricate into thin sheets because of their very low ductility at room temperature. As noted above, the TiAl based alloys can potentially be used at much higher temperatures than the $Ti_3Al$ compositions. Also, it is deemed that the TiAl alloys are excellent matrix alloys for silicon carbide reinforced composites as discussed above.

EXAMPLE 4

The procedure of Example 1 was again repeated. However, in this example a 1.5 inch diameter tube was used in place of the drum. A heavier plasma spray deposit of titanium base alloy, Ti-6Al-4V, was formed on the tube amounting to about one quarter of an inch. The thicker deposit was made so that tests of the tensile and elongation (ductility) properties of a plasma spray deposit could be made and compared to those of a wrought sample of the same alloy.

The sample deposit on the tube was hot isostatically pressed at 1000° C. following deposition of the deposit. The sample was not enclosed in a sealed can during the hot isostatic pressing because the as-deposited sample had closed porosity in the as-deposited condition.

Figure 5:
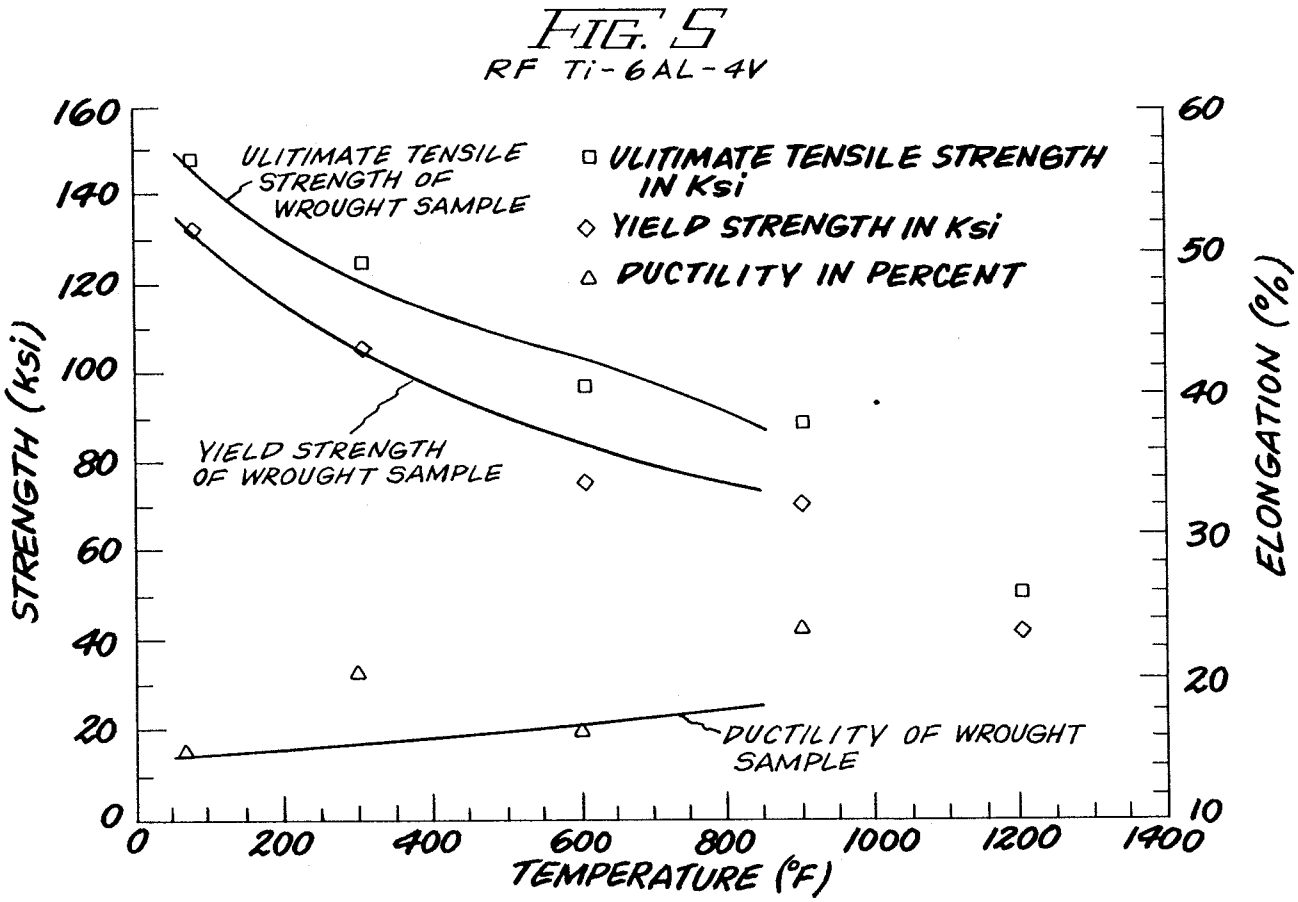
FIG. 5 is a graph in which temperature in degrees Fahrenheit is plotted against strength in ksi and elongation in percent.

The results of the tests are plotted in FIG. 5. With reference to this figure, the values of ultimate tensile strength, yield strength and ductility for the wrought alloy sample are shown by the solid lined plots of FIG. 5 for a temperature range of room temperature up to about 850° F.

The values of the ultimate tensile strength and ductility for the plasma spray deposited alloy Ti-6Al-4V are plotted according to the legends on the FIG. 5 for room temperature; 300° F.; 600° F.; 900° F. and 1200° F.

As is evident from the data in the plot of FIG. 5, the properties of the HIPed sample of the RF plasma spray deposited titanium base alloy were fully equivalent to those of a wrought sample prepared by conventional wrought processing. Based on these data, the properties of a HIPed foil prepared by the RF plasma spray deposit process were deemed to be essentially equivalent to those of wrought foil prepared by conventional casting and rolling processing.

What is claimed is:

1. The method of forming foil of alloys of titanium with other metals which comprises, providing a powder of a titanium based alloy to be formed into a foil, providing a drum adapted to being rotated in a low pressure plasma spray deposit apparatus, mounting a preformed foil of a metal of high melting point onto the drum to cover a cylindrical surface thereof, disposing the drum and foil in a low pressure plasma spray deposit apparatus, low pressure plasma spray depositing said powder onto the surface of the foil on said drum, separating the preformed foil and the titanium alloy deposit from the drum, and separating the preformed foil from the titanium alloy foil formed by the low pressure plasma deposit.

2. The method of claim 1 in which the titanium base metal alloy is Ti-6Al-4V.

3. The method of claim 1 in which the titanium base metal alloy is Ti-6Al-2Sn-4Zr-2Mo.

4. The method of claim 1 in which the titanium base metal alloy is based on the $Ti_3Al$ crystal structure and is $Ti_3Al$, or niobium modified $Ti_3Al$ (Ti-14Al-21Cb).

5. The method of claim 1 in which the titanium base metal alloy is based on a TiAl crystal structure.

6. The method of forming foils of titanium base alloys which comprises providing a radio frequency powered low pressure plasma spray apparatus, providing a powder of a titanium base alloy having an average particle size in excess of 100 μm, plasma spray depositing said titanium base alloy onto a substrate surface to produce a foil of said titanium base alloy, separating said foil from said substrate surface, and heat treating the foil to improve its properties.

7. The method of claim 6 wherein the titanium base alloy is Ti-6Al-4V.

8. The method of claim 6 wherein the titanium base alloy is Ti-6Al-2Sn-4Zr-2Mo.

9. The method of claim 6 wherein the titanium base alloy is $Ti_3Al$ or niobium modified $Ti_3Al$ (Ti-14Al-21Cb).

10. The method of claim 6 in which the titanium base alloy is TiAl.

* * * * *